United States Patent [19]

Kimata et al.

[11] 4,281,797

[45] Aug. 4, 1981

[54] FUEL INJECTION DEVICE FOR INTERNAL COMBUSTION ENGINES

[75] Inventors: Kei Kimata, Aichi; Masatoshi Kaneko, Iwata; Shoichi Fukunaga, Iwata; Toshiharu Kato, Iwata; Takeshi Ikeda, Iwata; Atsuo Suzuki, Kakegawa, all of Japan

[73] Assignee: NTN Toyo Bearing Company, Limited, Osaka, Japan

[21] Appl. No.: 928,152

[22] Filed: Jul. 26, 1978

[51] Int. Cl.[3] ..... F02M 61/08

[52] U.S. Cl. ..... 239/533.12; 239/575; 123/449; 123/468

[58] Field of Search ..... 123/139 BC, 139 DP, 123/32 JV, 139 AA, 139 AW; 239/452, 453, 533.2, 533.3, 533.6, 533.12, 590.3, 575

[56] References Cited

U.S. PATENT DOCUMENTS

| | | | |
|---|---|---|---|
| 1,112,416 | 9/1914 | Sargent | 239/453 |
| 2,279,010 | 4/1942 | Nichols | 123/139 DP |
| 2,633,187 | 3/1953 | Smith, Jr. | 123/139 BC |
| 2,756,107 | 7/1956 | Korda | 239/533.2 |
| 2,975,982 | 3/1961 | Dahl | 123/139 AW |
| 3,105,640 | 10/1963 | Allen | 239/453 |
| 3,227,147 | 1/1966 | Gossiaux | 123/139 AA |
| 3,510,112 | 5/1970 | Winquist et al. | 123/139 AW |
| 3,542,293 | 11/1970 | Bishop et al. | 239/453 |
| 3,613,998 | 10/1971 | Krauss | 239/453 |
| 3,800,769 | 4/1974 | Graffman | 123/139 AW |
| 3,901,204 | 8/1975 | Jaulmes | 123/139 AW |
| 3,980,237 | 9/1976 | Parrish, Jr. | 239/533.3 |
| 3,996,910 | 12/1976 | Noguchi et al. | 123/139 BC |
| 4,111,365 | 9/1978 | Kimbara | 239/533.3 |

*Primary Examiner*—Charles J. Myhre
*Assistant Examiner*—Andrew M. Dolinar
*Attorney, Agent, or Firm*—Armstrong, Nikaido, Marmelstein & Kubovcik

[57] ABSTRACT

A fuel injection device adapted to control the amount of injection by the opening time and opening area of a gate which is disposed in a fuel feed passage and which is controlled in connection with the engine rpm and the amount of suction air. The fuel injection device is characterized in that a choke is disposed between the fuel distributing port of a fuel measuring and distributing mechanism and the valve of an automatic valve type fuel injector, whereby the rate of flow and hence the rise time of pressure pulses applied to the injection valve are controlled to provide an accurate amount of injection.

3 Claims, 5 Drawing Figures a
b
t

FUEL INJECTION DEVICE FOR INTERNAL COMBUSTION ENGINES

BACKGROUND OF THE INVENTION (a) Field of the Invention

The present invention relates to a fuel injection device of the type adapted to measure fuel by the opening time and opening area of a gate disposed in a fuel feed passage. Particularly, it relates to improvements in the fuel injector.

(b) Description of the Prior Art

A known fuel injection device, as shown in FIG. 1, comprises a body 1 and a rotor 2 disposed in the body 1. The body 1 is provided with a fuel feed port 3, fuel distributing ports 4 equidistantly spaced in accordance with the number of cylinders of the engine, and measuring ports 5 communicating with said distributing ports 4. The rotor 2 is provided with a fuel inlet port 6 communicating with the fuel feed port 3 at all times, and a single fuel measuring port 8 communicating with said fuel inlet port 6 and associated with the measuring port 5 in the body. The measuring ports 5 and 8 in the body and rotor are a combination of windows substantially in the form of a triangle with one side circumferentially extending, and an orifice or a combination of windows substantially in the form of a rectangle with two sides extending circumferentially, and a slit, and they constitute a gate. The rotor 2 is driven for rotation in synchronism with the engine rpm and has its axial position controlled in accordance with the amount of air being sucked into the engine. As a result, the opening time of the gate 5, 8 is controlled in connection with the engine rpm and the amount of suction air. The fuel from a tank 9 is pressurized by a pump 10 and controlled to a constant pressure and it is fed to the fuel feed port 3. The fuel measured by the gate 5, 8 is distributed from the fuel distributing ports 4 and is injected into the suction pipe by an automatic valve type fuel injector 12. The injector 12 comprises an injection valve 14, a valve seat 15 and a valve opening pressure determining valve spring 16, which are disposed in a body 13.

In the fuel injection device of the type described above, the rise in the pressure of delivered fuel, particularly in the high speed range, is so sharp as to open the injection valve 14 too wide, causing a problem that an excessive amount of fuel is injected. FIG. 2 is a graph showing the delivery pressure of fuel measured at the distributing ports 4, it being seen that in the low speed range since the communication of the gate 5, 8 is gentle, the rise in the pressure is relatively gentle as shown at a, while in the high speed renge the pressure rises sharply as shown at b. On the other hand, since this pressure is applied directly to the injection valve 14, the latter will be opened suddenly. At this moment, the injection valve 14 which opens to the suction pipe is directly connected to the fuel tank 9 through the gate 5, 8, and the increase of the stroke of the injection valve 14, i.e., the increase of the degree of opening thereof will lead to the increase of the amount of injection.

Further, since the conventional fuel injector is of the type in which after the valve parts, i.e., the valve, the valve seat and the adjusting spring for adjusting the valve opening pressure have been assembled as a unit and adjusted, the injector is installed in the body, it has been impossible to finely adjust or alter the valve opening pressure. Further, since different valve opening pressures for the fuel injector are required for different fuel injection devices, exclusive injectors are required, which is irrational from the standpoint of manufacture.

SUMMARY OF THE INVENTION

The present invention is concerned with a fuel injection device adapted to control the amount of injection by the opening time and opening area of a gate which is disposed in a fuel feed passage and which is controlled in connection with the engine rpm and the amount of suction air. In such fuel injection device, according to the invention, a choke having a diameter of from 0.5 mm to 1.5 mm is disposed between the fuel distributing port of a fuel measuring and distributing mechanism and the injection valve of an automatic valve type fuel injector. Thus, the invention can be embodied extremely easily by simply inserting said choke without requiring any alteration, while ensuring an accurate amount of injection over the entire rotative speed range of the engine.

A fuel injector according to the invention comprises a body, a valve, an adjusting rod extending through said body to project from the rear surface thereof, a tension spring disposed between said valve and said adjusting rod, and means disposed outside the body for adjusting the force of the tension spring by displacing the adjusting rod. Therefore, the assembly and adjustment of the fuel injector are easy. The spring has hooks at its opposite ends, so that it is possible to reduce the bending moment acting on the valve and obtain an injector whose valve opening and closing operation is stabilized and highly accurate. Further, a steel ball used in ball bearings is employed for the valve head, so that a high precision valve is obtained. Further, it is also possible to install the choke in the vicinity of the inlet port o the fuel injector, so that the construction can be made compact.

DESCRIPTION OF THE PREFERRED EMBODIMENTS

Figures 1, 2, 3:
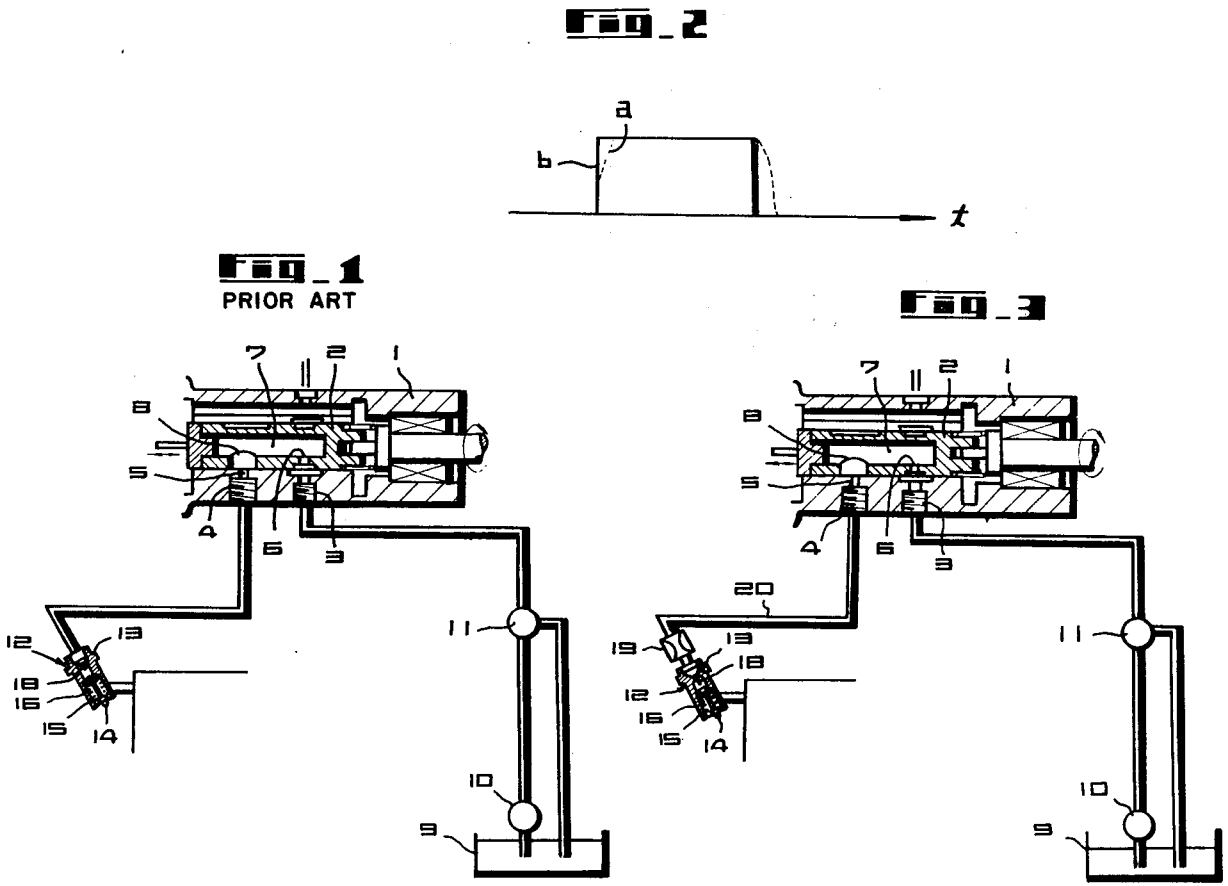
FIG. 1 PRIOR ART
FIG. 1 is a view for explaining an outline of a known injection device.
FIG. 2 is a view for explaining the condition of pressure in a fuel injection pipe passage.
FIG. 3 is a view for explaining an outline of a device constructed according to the invention.
Figure 4:
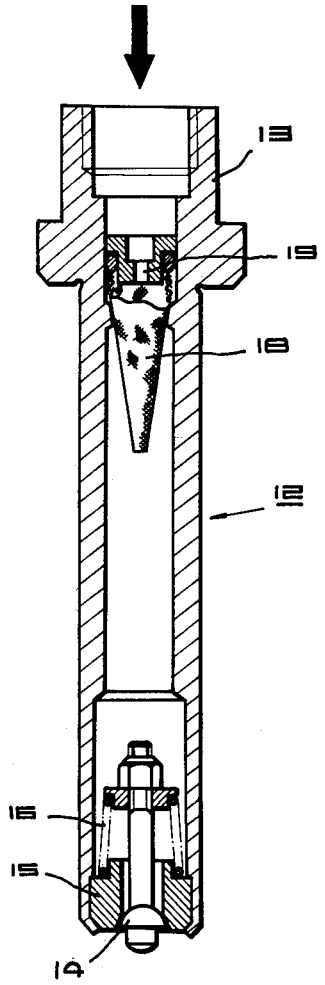
FIG. 4 is a view for explaining a state in which a choke is installed in a fuel injector.

In FIG. 3, the same reference characters as those in FIG. 1 indicate the same members. FIG. 3 shows a choke 19 disposed between an automatic valve type fuel injector 12 and the fuel distributing port 4 of a fuel measuring and distributing mechanism in order to prevent the amount of injection from varying owing to variations in the degree of opening incidental to variations in the pressure rise. It has been found that the optimum diameter of the choke ranges from 0.5 mm to 1.5 mm. That is, it has been found that diameters below 0.5 mm give too high a resistance while diameters above 1.5 mm do not serve the purpose. The choke 16 controls the rate of flow in the flow passage even if the pressure rises sharply, thereby making it possible to reduce the undesirable influence on the injection characteristic. Further, by adjusting the diameter of the choke, it is possible to adjust the injection characteristic to meet the amount of fuel required by the engine. In an optimum design, it is desirable to provide the choke 19 integrally within the body 13 of the automatic valve type fuel injector 12, as shown in FIG. 4. As for a line 20 connecting the distributing port 4 to the automatic valve type fuel injector 12, it is desirable to use a tube made of a high polymer which has a suitable degree of elasticity. With a rigid pipe, such as of metal, the propagation of pressure would be too fast, while a tube having visco-elasticity, such as of rubber, would absorb pressure, a fact which is undesirable.

Figure 5:
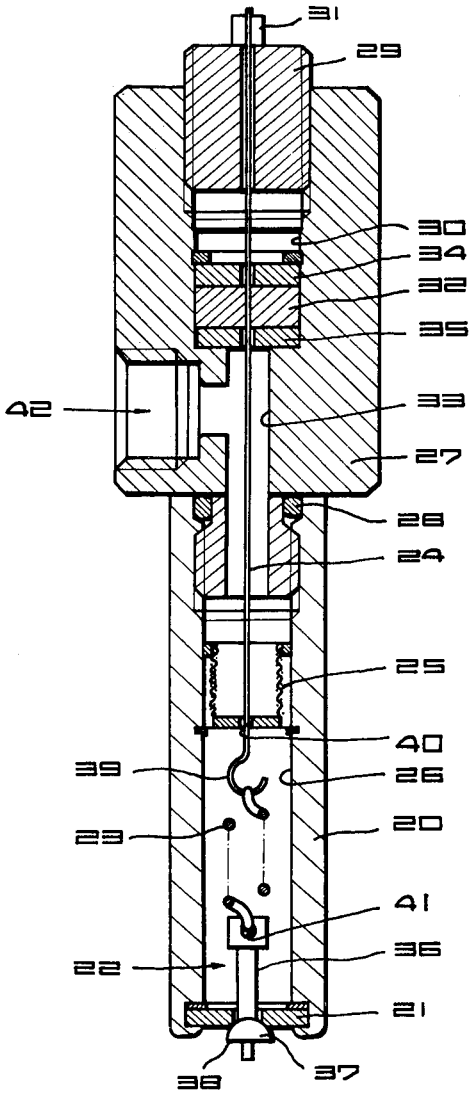
FIG. 5 is a view for explaining another embodiment of a fuel injector according to the invention.

FIG. 5 shows another embodiment of a fuel injector according to the invention. The numeral 20 designates the body of the injector; 21 designates a valve seat fixed by being crimped to the body; 22 designates a valve; 23 designates an adjusting spring for regulating the valve opening pressure; 24 designates an adjusting rod for adjusting the spring pressure of the adjusting spring 23; 25 designates a filter disposed in a bore 26 in the body; 27 designates a rear barrel engaged with the body; 28 designates an O-ring for sealing between the body 20 and the rear barrel; 29 designates an adjusting screw threadedly engaged in the bore 30 of the body 20; 31 designates a locking member for fixing the adjusting rod 24 extending through the body and the rear barrel 27; 32 designates a seal member for sealing between the bore 30 and a fuel passage 33; and 34 and 35 designate backup rings. The valve 22 is composed of a steel ball 37 welded to a valve stem 36, and the steel ball 37 is formed with an edge 38 by partly cutting away the steel in such a manner as to cause the spray of fuel to spread in the form of a flare. The adjusting spring 23 is formed with hooks at its opposite ends engaged with the hook 39 of the adjusting rod 24 and a hole 41 in the rear end of the valve stem 36. The adjusting rod 24 is guided by the hole 40 of the filter 25 so as not to move radially. The fuel is fed from the inlet port 42 to the passage 33 and then to the bore 26, and when its pressure exceeds the valve opening pressure, it opens the valve 22 against the force of the tension spring 23 to be injected into the suction pipe. The adjustment of the valve opening pressure is made after the assembly of the injector by moving the adjusting rod 24 upwardly or downwardly while causing fuel to flow at a predetermined pressure until a preset pressure is reached whereupon the adjusting rod 24 and the locking member 31 are crimped together. Thereafter, fine adjustments will be made by the adjusting screw 29. In addition, since the adjustment of the valve opening pressure is made while causing the fluid to flow, the adjusting screw 29 is not absolutely necessary. The fuel injector shown in FIG. 5 is not provided with a choke, but by installing one, e.g., between the inlet port 42 and the passage 33 it is possible to prevent the amount of injection from varying owing to variations in the degree of opening incidental to variations in the pressure rise.

While specific embodiments of the invention have been described in detail with reference to the accompanying drawings, it is to be understood that the invention is not limited thereto and that various changes and modifications may be made by those skilled in the art without departing from the spirit and scope of the invention.

What is claimed is:

1. An automatic valve-type fuel injector comprising:

an elongated body having a longitudinally extending bore formed therein and a fuel inlet port communicating with the bore;

a valve element having a hemispherically-shaped head portion and a stem portion to the leading end of which the head portion is joined;

a valve seat fixed to the leading end of the bore and having a central aperture through which the stem portion of the valve element extends with an ample clearance therebetween for the passage of fuel and which is provided with an annular edge for the fuel-tight contact during non-injection period with the cooperating hemispherical surface of the head portion of the valve element;

an adjusting rod extending through the bore to project beyond the rear thereof;

a tension spring provided at its opposite ends with hooks which engage with the rearward end of the stem portion of the valve element and leading end of the adjusting rod, respectively;

a seal member housed in a rearward end of the bore and receiving the adjusting rod in a fuel-tight fashion;

a locking member disposed outside the body for locking the adjusting rod at its desired longitudinal position so as to set the force of the tension spring that determines the valve opening pressure; and an adjusting screw having a screw thread on its outer periphery engaging a complementary screw thread formed at the rearward end of the bore in the body, said adjusting screw having a central aperture through which the adjusting rod extends and bearing on its outer end surface said locking member.

2. An automatic valve-type fuel injector comprising:

an elongated body having a longitudinally extending bore formed therein and a fuel inlet port communicating with the bore;

a valve element having a hemispherically-shaped head portion and a stem portion to the leading end of which the head portion is joined;

a valve seat fixed to the leading end of the bore and having a central aperture through which the stem portion of the valve element extends with an ample clearance therebetween for the passage of fuel and which is provided with an annular edge for the fuel-tight contact during non-injection period with the cooperating hemispherical surface of the head portion of the valve element;

an adjusting rod extending through the bore to project beyond the rear thereof;

a tension spring provided at its opposite ends with hooks which engage with the rearward end of the stem portion of the valve element and leading end of the adjusting rod, respectively;

a seal member housed in a rearward end of the bore and receiving the adjusting rod in a fuel-tight fashion;

a locking member disposed outside the body for locking the adjusting rod at its desired longitudinal position so as to set the force of the tension spring that determines the valve opening pressure; and a filter element housed within the bore between the fuel inlet port and the valve seat, said filter element having a central aperture formed therein for guiding radially the adjusting rod.

3. An automatic valve-type fuel injector comprising:

an elongated body having a longitudinally extending bore formed therein and a fuel inlet port communicating with the bore;

a valve element having a hemispherically-shaped head portion and a stem portion to the leading end of which the head portion is joined;

a valve seat fixed to the leading end of the bore and having a central aperture through which the stem portion of the valve element extends with an ample clearance therebetween for the passage of fuel and which is provided with an annular edge for the fuel-tight contact during non-injection period with the cooperating hemispherical surface of the head portion of the valve element;

an adjusting rod extending through the bore to project beyond the rear thereof;

a tension spring provided at its opposite ends with hooks which engage with the rearward end of the stem portion of the valve element and leading end of the adjusting rod, respectively;

a seal member housed in a rearward end of the bore and receiving the adjusting rod in a fuel-tight fashion;

a locking member disposed outside the body for locking the adjusting rod at its desired longitudinal position so as to set the force of the tension spring that determines the valve opening pressure; and a guiding member housed within the bore between the fuel inlet port and the valve seat such that the fuel may pass therethrough, said guiding member having a central aperture formed therein for guiding radially the adjusting rod.

* * * * *